US008353063B1

(12) United States Patent
Thomas et al.

(10) Patent No.: US 8,353,063 B1
(45) Date of Patent: Jan. 15, 2013

(54) PROTECTIVE GARMENT FOR BRIDAL GOWN

(75) Inventors: Mary Thomas, Owasso, OK (US); Miranda Rene Thomas, Owasso, OK (US)

(73) Assignee: Bellabito, LLC, Owasso, OK (US)

( * ) Notice: Subject to any disclaimer, the term of this patent is extended or adjusted under 35 U.S.C. 154(b) by 0 days.

(21) Appl. No.: 13/276,690

(22) Filed: Oct. 19, 2011

Related U.S. Application Data

(63) Continuation-in-part of application No. 12/879,146, filed on Sep. 10, 2010, now abandoned.

(51) Int. Cl.
*A41D 27/12* (2006.01)

(52) U.S. Cl. ..... 2/47; 2/217

(58) Field of Classification Search ..... 2/46, 47, 2/48, 52, 51, 69, 69.5, 73, 74, 85, 105, 109, 2/110, 217, 222, 215, 211, 214, 223, 300, 2/301, 311, 315, 314, 400, 406, 207, 216
See application file for complete search history.

(56) References Cited

U.S. PATENT DOCUMENTS

| | | | | | |
|---|---|---|---|---|---|
| 56,341 | A | | 7/1866 | Phelps | |
| 57,950 | A | * | 9/1866 | Moody | 2/217 |
| 263,541 | A | * | 8/1882 | Lathrop | 2/47 |
| 282,646 | A | * | 8/1883 | Knight et al. | 2/47 |
| 365,450 | A | | 6/1887 | St. Clair | |
| 419,968 | A | | 1/1890 | McQuiston | |
| 510,324 | A | | 12/1893 | Buchanan | |
| 624,114 | A | | 5/1899 | Stears | |
| 724,758 | A | * | 4/1903 | Todd | 2/217 |
| 2,127,763 | A | * | 8/1938 | Bentz | 2/85 |
| 2,687,530 | A | * | 8/1954 | Farnum | 2/217 |
| 2,692,988 | A | * | 11/1954 | Rouse | 2/73 |
| 2,752,603 | A | | 7/1956 | Greene | |
| 2,798,224 | A | | 7/1957 | Jennings | |
| 2,994,088 | A | | 8/1961 | Marks | |
| 3,693,189 | A | | 9/1972 | Mundt | |
| 3,721,997 | A | | 3/1973 | Mundt | |
| 4,774,726 | A | | 10/1988 | Garrett | |
| 5,052,059 | A | | 10/1991 | Speer | |
| 5,546,606 | A | | 8/1996 | Luckabaugh | |
| 5,765,232 | A | | 6/1998 | Pryor | |
| D402,439 | S | * | 12/1998 | Marks | D2/757 |
| 7,725,952 | B1 | | 6/2010 | Wight | |
| 2012/0110719 | A1 | * | 5/2012 | Glenn et al. | 2/217 |

* cited by examiner

*Primary Examiner* — Amy Vanatta
(74) *Attorney, Agent, or Firm* — Molly D. McKay

(57) ABSTRACT

A garment worn under a bridal gown in a manner similar to a petticoat having vertical strips of elastic to retract the garment under the gown for photographs. The elasticized hem of the garment can be pulled from under the bottom of the gown to allow the wearer to carry the gown and protect it from being soiled. The garment is provided with a tight fitting waistband that secures around the wearer's waist. A skirt of the garment is somewhat circular with the front somewhat shorter in length than the back. Loops are provided near the hem as a means for holding the hem of the garment when carrying the gown within the garment. An elastic band from the garment's hem can be pulled from the casing as shoulder straps for carrying the gown hands-free.

9 Claims, 4 Drawing Sheets

PROTECTIVE GARMENT FOR BRIDAL GOWN

CROSS-REFERENCE TO RELATED APPLICATIONS

The present invention is a continuation in part of U.S. patent application Ser. No. 12/879,146 for the invention entitled Protective Garment for Bridal Gown that was filed on Sep. 10, 2010 now abandoned.

BACKGROUND OF THE INVENTION

1. Field of the Invention

The present invention relates to a garment that can be hidden under a bridal gown when bridal photographs are being made and can be lifted up over the bottom of the gown as a protective containment structure which the bride can use to carry the bottom of her gown to prevent the gown from being soiled as the bride rides in a vehicle or walks to an outdoor location where she is to be photographed.

2. Description of the Related Art

Brides are very nervous about losing control of their wedding gowns prior to their wedding. Often the bride will have expended a great deal of time and money in selecting and acquiring the perfect gown for her wedding. Once the bride has possession of her gown, she does not want to soil it prior to the wedding because if it becomes soiled, it will have to be cleaned. If it must go to the cleaners, the bride will lose control and possession of the gown and will be concerned about the dry cleaner ruining it or causing it to shrink or otherwise become damaged. Wedding day jitters are bad enough without the bride having additional worries about whether she will have her perfect gown to wear.

It is often desirable to have wedding photographs made prior to the wedding and more and more brides are choosing to have photographs made in out of door locations, such as parks, etc. These outdoor locations add to the concern and probability that the wedding gown will become soiled prior to the wedding. Usually, during the photo shoot, the bride and her bridesmaids will try to lift and carry the hem of the gown and the long train to prevent them from coming into contact with the ground in an effort to prevent the gown from being soiled. However, currently there is not any way for a bride to protect the long gown and train unaided as she moves to the location where the photographs are to be taken and also moves about at the location to have various photographs made.

The present invention addresses this problem by providing a garment that is worn under the gown and can be hidden under the gown while pictures are being made. Once the pictures are made, the hem of the garment can be pulled out from under the gown and used to contain, lift and carry the hem of the gown to prevent it from being soiled.

SUMMARY OF THE INVENTION

The present invention is a garment that is worn under a bridal gown and can be hidden under the gown when bridal photographs are being made. The hem of the garment can be grasped and pulled out from under the bottom of the gown and then up around the gown as a protective containment structure to prevent the gown from being soiled so that the bride can ride in a vehicle or walk to an outdoor location where she is to be photographed without the danger of having her gown become soiled.

The garment is full with a large amount of fabric and is approximately circular when it is laid out flat, as shown in FIG. 1. The garment is proved centrally with a waistband that secures around the wearer's waist. The garment is worn under the bridal gown in a manner similar to a slip or petticoat. The hem of the garment is preferably provided with an elasticized edge that allows the garment to be pulled down under the hem of the bridal gown and then up on the outside of the gown to capture and contain the gown within the garment. The wearer then grasps the elasticized edge of the garment to hold the gown up and carry it as she walks and moves around, thereby preventing the hem of the gown from becoming soiled even when the bride traverses areas where the gown would otherwise come in contact with dirty surfaces or vegetation that would tend to soil or tear the gown.

The garment may be made with a wide waistband that is constructed of a tight fitting material, such as spandex material or other similar material that will cling to the wearer but not add bulk to the wearer's waistline underneath the dress. Spandex is the preferred name for this material in North America, elastane is the name used in many European countries and LYCRA is the principal name employed in Britain. Brand names for spandex include LYCRA, ELASPAN, CREORA, ROICA, DORLASTAN, LINEL, and ESPA.

The front of the garment is preferably somewhat shorter in length than the back of the garment to permit ease in walking with the garment.

Also loops are provided on the underside of the garment near the hem as a means for holding the hem of the garment up when carrying the bridal gown within the garment. Additionally, the garment's hem is provided with a casing through which a continuous elastic band is inserted as a means of gathering the hem. The casing is open at the sides or at various intervals so that the elastic band can be pulled from the casing to provide an additional means of holding the hem of the garment up when carrying the bridal gown within the garment. The elastic band can be pulled from the casing sufficiently so that the elastic band can be used as a shoulder strap by the wearer to assist the wearer in carrying the bridal gown in a hands free mode.

The garment is provided with a plurality of vertical strips of elastic material that help to retract the garment upward under the bridal gown so that the garment is completely concealed under the bridal gown when the garment is not being used to carry the bridal gown.

DETAILED DESCRIPTION OF THE PREFERRED EMBODIMENT

Figure 1:
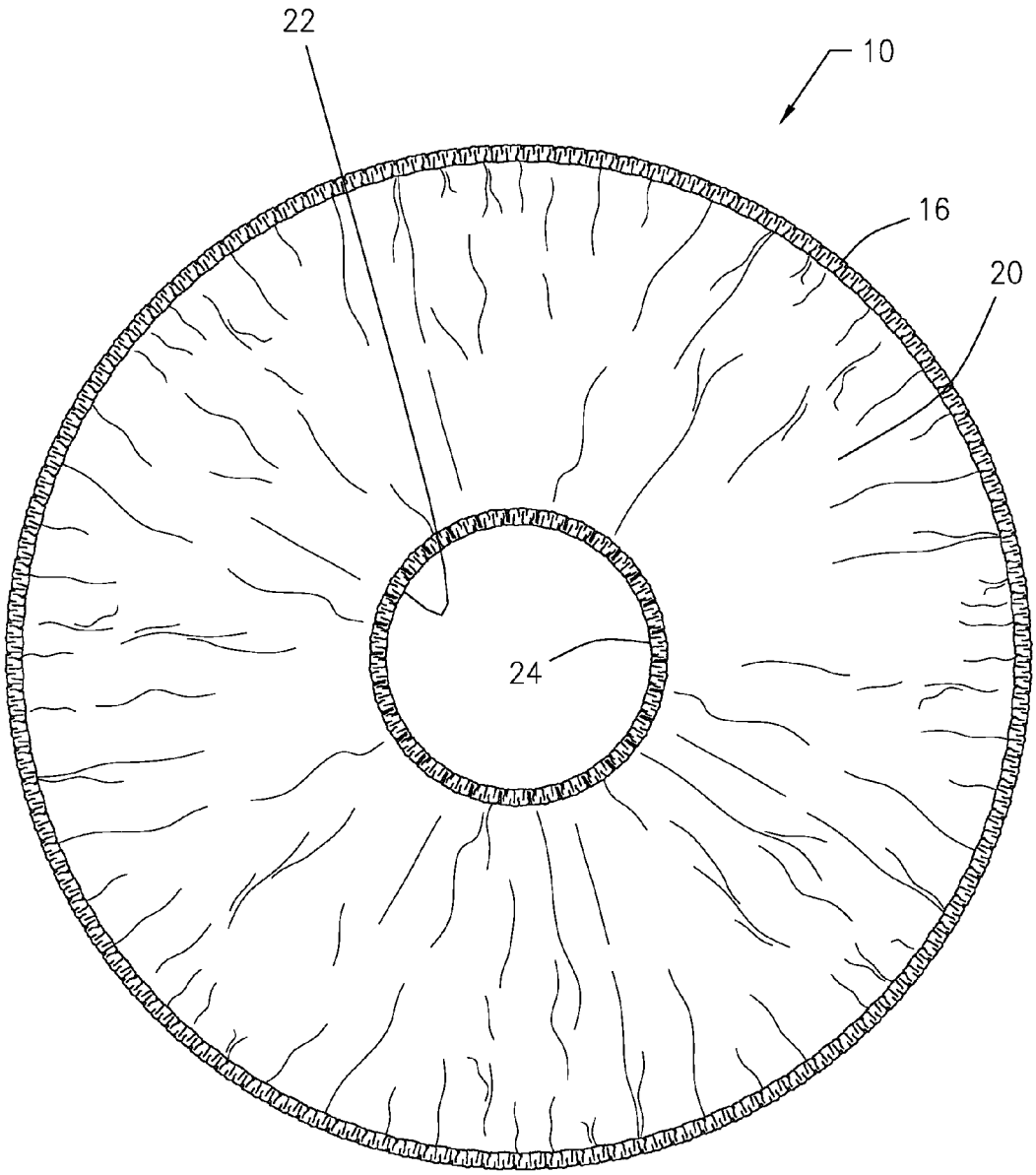
FIG. 1 is a top plan view of the protective garment for bridal gown constructed in accordance with a preferred embodiment of the present invention
Figure 3:
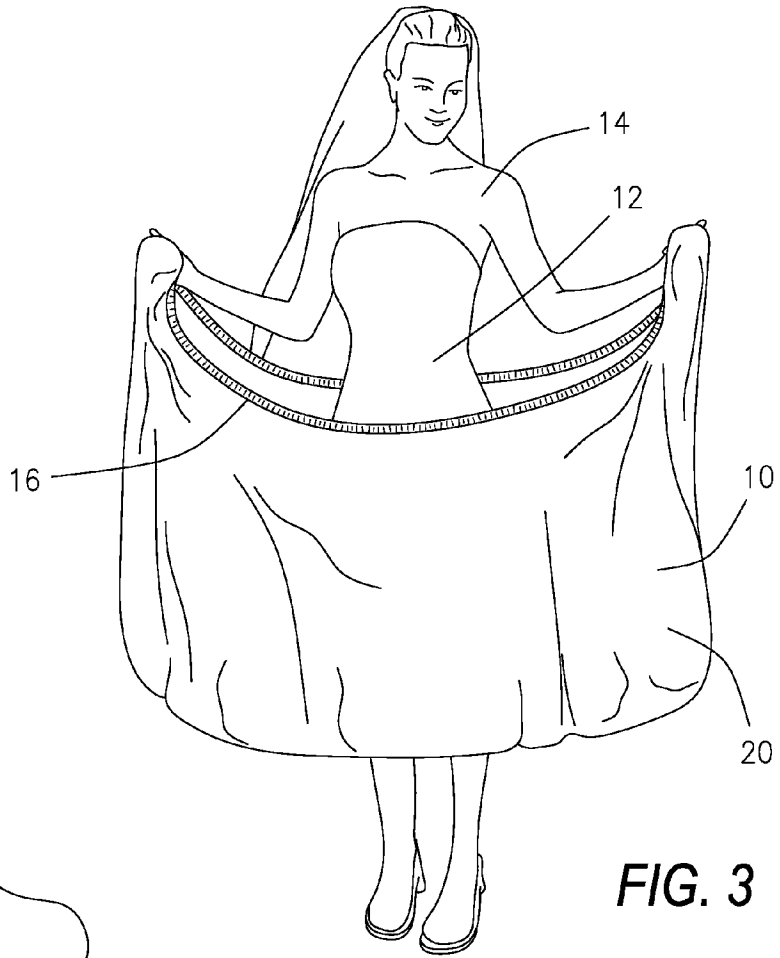
FIG. 3 is a perspective view showing the protective garment that had its hem pulled out from under the bridal gown and is being used by the wearer as a means of carrying and protecting the bridal gown from being soiled as she moves around.
Figure 2:
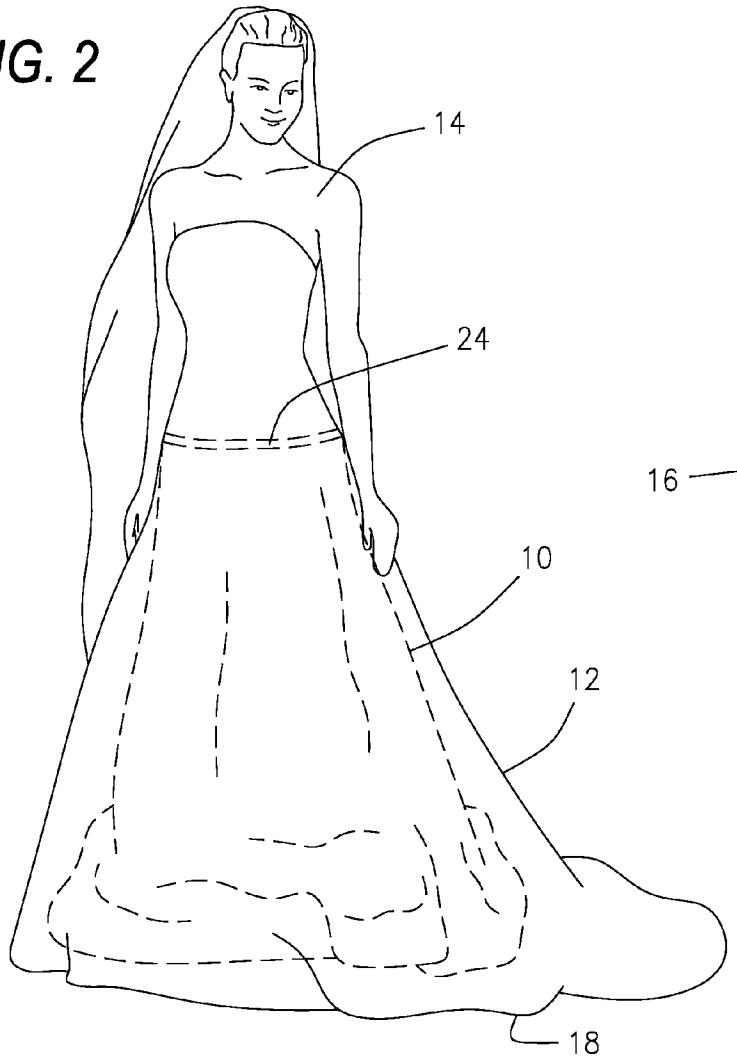
FIG. 2 is a perspective view showing the protective garment in dashed lines in use underneath a bridal gown of a wearer.

Referring now to FIG. 1, there is illustrated a garment 10 for use with a long gown 12, such as a bridal gown, that is constructed in accordance with a preferred embodiment of the present invention. As illustrated in FIG. 3, the garment 10 allows the gown 12 to be lifted and carried within the garment 10 by the wearer 14 so that the gown 12 does not become soiled while moving around in the gown 12, such as when bridal photographs are taken out of doors prior to the wedding. Referring to FIG. 2, the garment 10 is worn under a bridal gown 12 and can be hidden under the gown 12 when bridal photographs are being made. A hem 16 of the garment 10 can be lifted out from under the gown 12 and then up over the bottom or hem 18 of the gown 12 as a protective containment structure to prevent the gown 12 from being soiled so that the bride 14 can ride in a vehicle or walk to an outdoor location where she is to be photographed without the danger of having her gown 12 become soiled.

Referring again to FIG. 1, the garment 10 is full with a large amount of fabric in the skirt 20 of the garment 10 so that the skirt 20 is approximately circular when it is laid out flat. The garment 10 is provided centrally with a waist opening 22 and a waistband 24 surrounding the waist opening 22 that secures around the wearer's waist area. The waistband 24 is preferably elasticized. The garment 10 is worn under the bridal gown 12 in a manner similar to a traditional slip or petticoat.

The hem 16 of the garment 10 is preferably provided with an elasticized edge or drawstring arrangement that allows the garment 10 to be pulled down under the hem 18 of the bridal gown 12 and then up on the outside of the gown 12 to capture and contain the gown 12 within the garment 10. The elasticized edge or drawing string hem 16 then allows the wearer 14 to hold the elasticized edge or drawstring hem 16 of the garment 10 in a smaller circumference so that the wearer 14 can easily manage to hold the hem 18 and a portion of the gown 12 contained within the garment 10. Once the gown 12 is thus contained within the garment 10, the wearer 14 grasps the elasticized edge or drawstring hem 16 of the garment 10 to hold the gown 12 up and to carry it as she walks and moves around, thereby preventing the hem 18 of the gown 12 from becoming soiled even when the bride 14 traverses areas where the gown 12 would otherwise come in contact with dirty surfaces or vegetation that would tend to soil the gown 12. This process of carrying the gown 12 within the garment 10 and then hiding the garment 10 back under the gown 12 so that bridal photographs can be taken can be repeated as needed to allow the bride 14 to move around comfortably for the photography session without soiling her gown 12.

Figure 4:
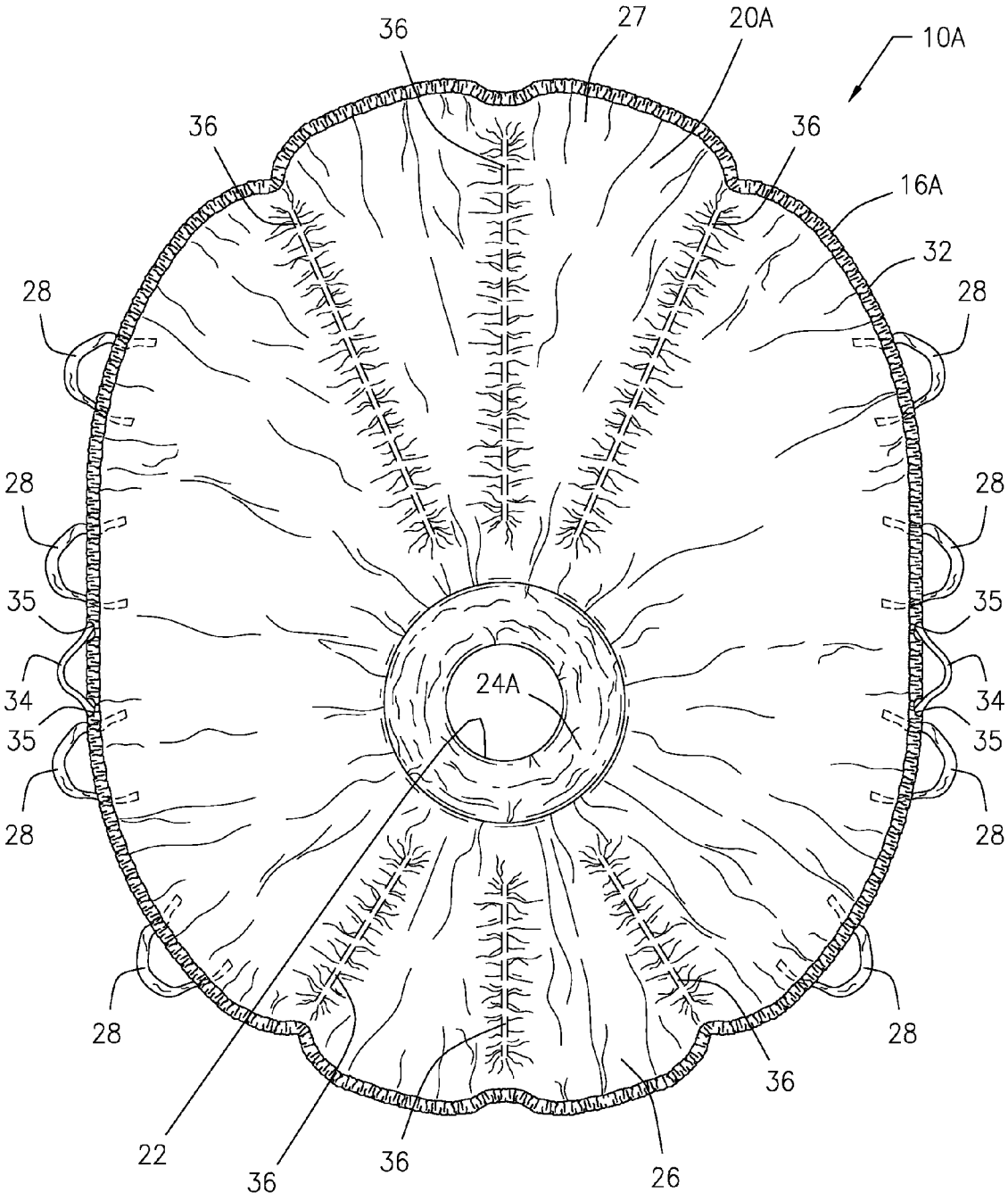
FIG. 4 is a top plan view of an alternate embodiment protective garment for bridal gown constructed in accordance with an alternate embodiment of the present invention.
Figure 6:
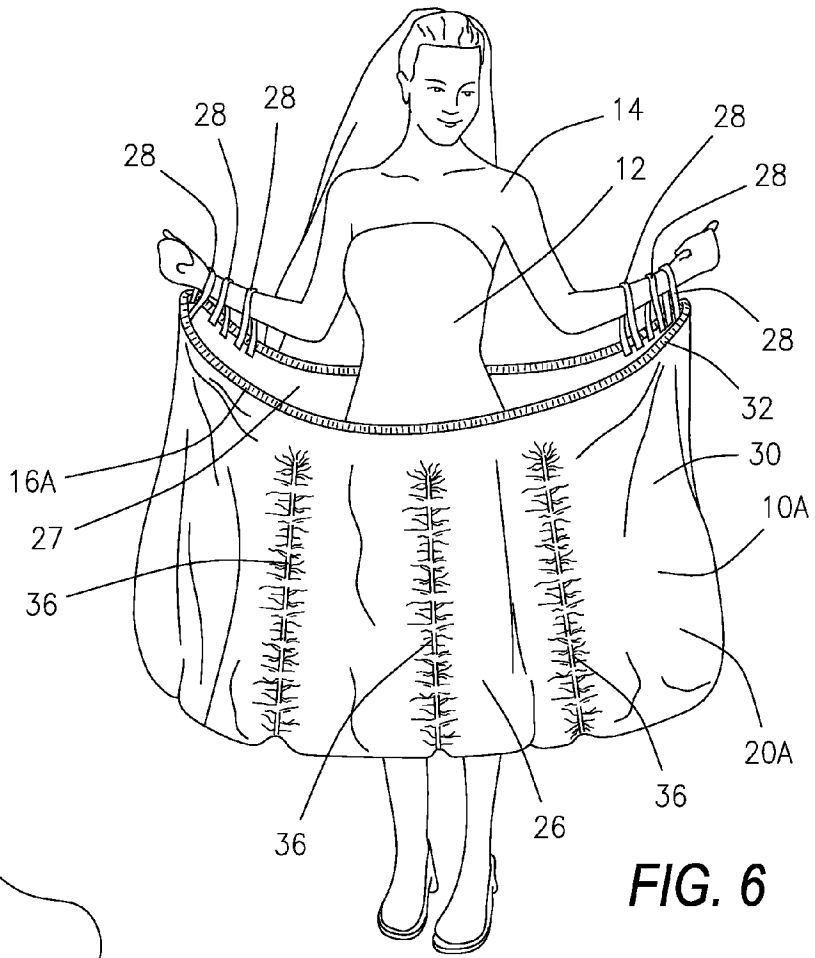
FIG. 6 is a perspective view showing the alternate protective garment that had its hem pulled out from under the bridal gown and with the user employing hand loops provided on the hem as a means of carrying and protecting the bridal gown from being soiled as she moves around.
Figure 5:
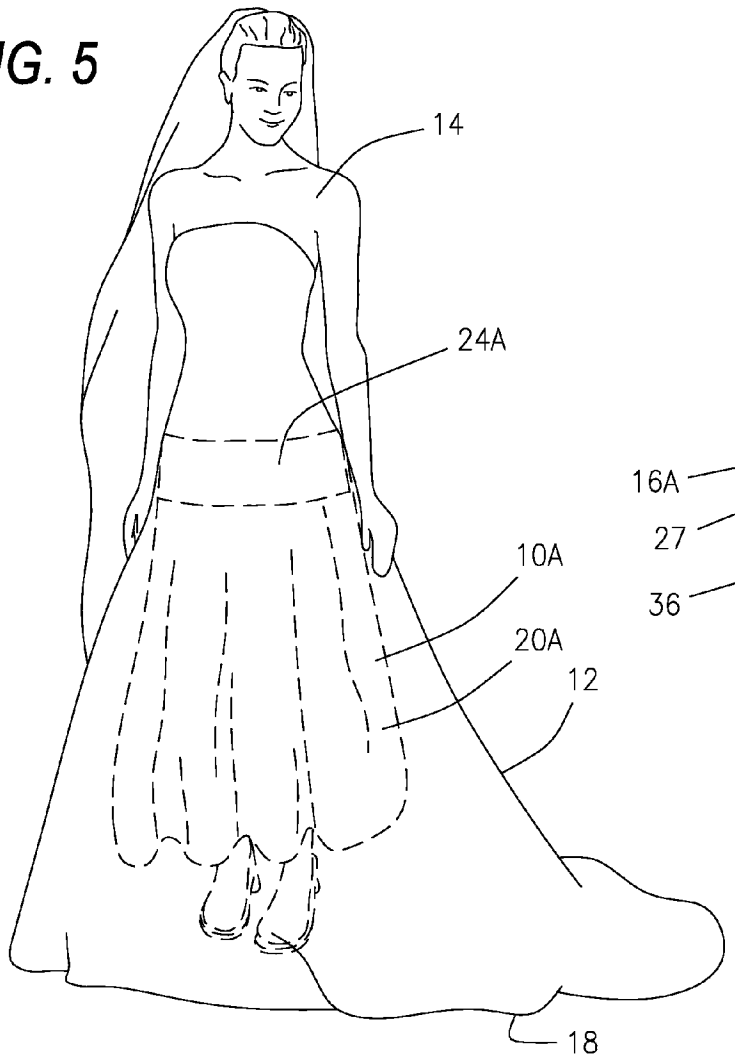
FIG. 5 is a perspective view showing the alternate embodiment protective garment of FIG. 4 in dashed lines in use underneath a bridal gown of a wearer.

Referring now to FIGS. 4-6, there is illustrated an alternate embodiment garment 10A of the present invention that includes additional features. As illustrated in FIGS. 4 and 5, the alternate garment 10A may be made with a wide waistband 24A that is constructed of a tight fitting material, such as spandex material or other similar material that will cling to the wearer 14 but not add bulk to the wearer's waistline underneath the gown 12. Also, as shown in FIG. 4, the front 26 of the skirt 20A of the alternate garment 10A is preferably somewhat shorter in length than the back 27 of the alternate garment 10A to permit ease in walking with the alternate garment 10A.

Referring to FIGS. 4 and 6, hand loops 28 are provided on the underside 30 of the alternate garment 10A near the hem 16A as a means of holding the hem 16A of the alternate garment 10A up when carrying the gown 12 within the alternate garment 10A. Additionally, as illustrated in FIG. 4, the hem 16A of the alternate garment 10A is provided with a casing 32 through which a continuous elastic band 34 is inserted as a means of gathering the hem 16A.

The casing 32 is open at various locations 35 so that the elastic band 34 can be partially pulled from the casing 32 to provide an additional means of holding the hem 16A of the alternate garment 10A up when carrying the gown 12 within the alternate garment 10A. Although not illustrated, the elastic band 34 can be pulled from the casing 32 sufficiently so that the exposed portion of the elastic band 34 can be used as a shoulder strap by the wearer 14 to assist the wearer 14 in carrying the gown 12 in a hands free mode.

As shown in FIGS. 4 and 6, the alternate garment 10A is provided with a plurality of vertical elastic strips 36 attached to the skirt 20A of the alternate garment 10A that help to retract the hem 16A of alternate garment 10A upward under the gown 12 so that the alternate garment 10A is completely concealed under the gown 12 when the alternate garment 10A is not being used to carry the gown 12, as shown in FIG. 5.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A protective garment for a gown comprising:

a long garment to be worn underneath a gown, the garment provided with a centrally located waist opening which is surrounded by a waistband for fitting around a wearer's waist, a skirt of the garment provided with a hem, the hem provided with means for reversibly gathering the hem of the garment into a smaller circumference so that the hem can be grasped by the wearer as a means of carrying a lower portion or hem of the gown within the garment where it is protected from being soiled, and a plurality of vertical strips of elastic material attached to the skirt of the garment that help to retract the garment upward under the gown so that the garment is completely concealed under the gown when the garment is not being used to carry the gown.

2. A protective garment according to claim 1 further wherein said waistband is elasticized.

3. A protective garment according to claim 1 wherein said means for reversibly gathering the hem of the garment into a smaller circumference comprises an elastic band contained within a hem casing.

4. A protective garment according to claim 3 further comprising:

openings provided in the hem casing which allow access to the elastic band which can be pulled from the casing to provide an additional means of holding the hem of the garment up when carrying the gown within the garment.

5. A protective garment according to claim 4 wherein the elastic band can be pulled from the openings in the hem casing sufficiently so that the elastic band can be used as a shoulder strap by the wearer to assist the wearer in carrying the gown in a hands free mode.

6. A protective garment according to claim 1 further comprising:

said waistband being constructed as a tight fitting material that will cling to the wearer but not add bulk to the wearer's waistline underneath the gown.

7. A protective garment according to claim 1 wherein a front of the garment is somewhat shorter in length than a back of the garment to permit ease in walking with the garment.

8. A protective garment according to claim 1 further comprising:

non-elastic loops are provided on the garment near the hem as a means for holding the hem of the garment up when carrying the gown within the garment.

9. A protective garment for a gown comprising:

a long garment to be worn underneath a gown, the garment provided with a centrally located waist opening which is surrounded by an elasticized waistband for fitting around a wearer's waist without adding bulk under a gown, a skirt of the garment provided with a hem that can be grasped to carry the gown within the garment, a front of the garment being shorter in length than a back of the garment to permit ease in walking with the garment, loops provided on the garment near the hem as a means for holding the hem of the garment up when carrying the gown within the garment, the hem provided with an elastic band contained within a hem casing as a means for reversibly gathering the hem of the garment into a smaller circumference, the hem casing provided with openings therein that allow access to the elastic band so that said elastic band can be pulled from the casing to provide an additional means of holding the hem of the garment up when carrying the gown within the garment and can be used as a shoulder strap by the wearer to assist the wearer in carrying the gown in a hands free mode, and a plurality of vertical strips of elastic material attached to the skirt of the garment that help to retract the garment upward under the gown so that the garment is completely concealed under the gown when the garment is not being used to carry the gown.

* * * * *